US006168556B1

(12) United States Patent
Saavedra

(10) Patent No.: US 6,168,556 B1
(45) Date of Patent: Jan. 2, 2001

(54) WRIST STRAP APPARATUS FOR USE IN WEIGHT TRAINING

(75) Inventor: Mario Saavedra, San Juan Capistrano, CA (US)

(73) Assignee: Sylvia Heinsbergen, San Juan Capistrano, CA (US)

( * ) Notice: Under 35 U.S.C. 154(b), the term of this patent shall be extended for 0 days.

(21) Appl. No.: 09/285,918

(22) Filed: Apr. 2, 1999

(51) Int. Cl.[7] ..... A63B 21/06

(52) U.S. Cl. ..... 482/93; 482/105; 482/106; 482/139; 224/220; 224/267

(58) Field of Search ..... 482/92, 93, 105, 482/106, 108, 139; 2/170, 161.1; 224/219–222, 267

(56) References Cited

U.S. PATENT DOCUMENTS 3,536,068 10/1970 Stubbs .
5,557,806 9/1996 Caswell et al. ..... 2/161.1
5,809,569 9/1999 Bruno et al. ..... 2/170
5,997,494 12/1999 Watkins et al. ..... 482/105

*Primary Examiner*—John Mulcahy
(74) *Attorney, Agent, or Firm*—Edward E. Roberts

(57) ABSTRACT

A weight training wrist strap apparatus for use by one with limited or essentially no handgrip strength is provided, the invention comprising a first strap for wrapping around a human wrist which includes a depending strap portion having an attachment clip for connection to weight training equipment. If desired, a second strap is provided for wrapping around the first strap for added stabilization of the first strap when using increased weight resistance. In this manner, all of the weight training force is transferred to the wrist of the user with the result that no gripping of the equipment by the hand of the user is necessary. The second strap may include a thumb loop for anchoring the strap for ease of wrapping the second strap to complete the apparatus-wrapping maneuver. Implementation and use of the apparatus provides for a complete upper body workout wherein increasingly heavier weight resistance without the requirement of gripping strength. The wrist strap is formed of a few strong, simple and durable parts, which will be easy to use and inexpensive to manufacture.

20 Claims, 3 Drawing Sheets

WRIST STRAP APPARATUS FOR USE IN WEIGHT TRAINING

BACKGROUND OF THE INVENTION

The background of the invention will be discussed in two parts.

1. Field of the Invention

This invention relates to a wrist strap apparatus for use in weight training, and more particularly to a wrist strap, and associated connector to weight training equipment, for use by one having limited, weakened or essentially no hand grip strength.

2. Description of the Prior Art

Weight training is known to be an important method of exercise for many reasons such as conditioning for athletic activities, an aid in prevention or postponement of diseases such as osteoporosis, physical therapy after injury or disease, and even as an aid in relieving stress. During weight training, the hands of the person are commonly applied around a bar or some other object to be gripped, whether it is with "free" weights, weight machines, or pulley apparatus. In any event, during weight training the strength, or adequacy, of the person's grip on the equipment used is very important. If the person does not get a good grip on the equipment, such as the bar supporting the weights, then a lesser amount of weight must be used. Further, the person may even lose his or her control, or even grip, on the bar or apparatus.

The prior art discloses devices of interest wherein wrist straps are used to facilitate a better or more controlled grip during the lifting of weights. One such wrist strap is shown and described in U.S. Pat. No. 5,745,920 issued to Olivier on May 5, 1998. The Olivier patent discloses a weightlifting hand strap for use with a weightlifting bar wherein a self-coiling spring strip is operable to wrap around the weightlifting bar to facilitate a better grip of the bar by the lifter. Although not used for weight training, another wrist strap device is shown and described in U.S. Pat. No. 2,288,150 issued to Wyman on Jul. 28, 1941 which discloses a wrist strap operable with a golf club with the object of controlling or preventing over-swing of the golf club.

A search of the prior art has not disclosed wrist strap means for facilitating a better grip for those with physical limitations resulting in limited, weakened or the absence of hand grip strength.

It is an object of the present invention to provide wrist strap apparatus, which is easy to use with weight training equipment, which facilitates the ability of one with, limited handgrip strength to participate in weight training activities.

It is a further object of the present invention to provide wrist strap apparatus, which transfers a great deal, or all, of the weight training effort to the wrist and forearms.

It is a further object of the present invention to provide a wrist strap for weight training that is formed of a few strong, simple and durable parts, which will be easy to use and inexpensive to manufacture.

The foregoing and other objects, features and advantages of the invention will become readily apparent from a reading of the specification, when taken in conjunction with the drawings, wherein there is shown and described a wrist strap apparatus for use in weight training by one with limited or weakened hand grip strength, and in which like reference numerals refer to like elements in the several figures.

SUMMARY OF THE INVENTION

The present invention is a weight training wrist strap apparatus for use by one with limited, weakened, or virtually no handgrip strength. The invention comprises a strap for wrapping around a human wrist which includes a depending strap portion having an attachment clip for connection to weight training equipment, and if needed, a second strap for wrapping around the first strap for added strength and stabilization of the first strap. In this manner, all of the weight training force is transferred to the wrist of the user with the result that no gripping of the equipment by the hand of the user is necessary. The second strap may include a thumb loop for anchoring the strap for ease of wrapping the second strap to complete the apparatus-wrapping maneuver. Implementation and use of the apparatus provides for a complete upper body workout wherein increasingly heavier weight resistance without the requirement of gripping strength. There is thus provided a wrist strap for weight training that is formed of a few strong, simple and durable parts, which will be easy to use and inexpensive to manufacture.

DESCRIPTION OF THE PREFERRED EMBODIMENT

Figure 1:
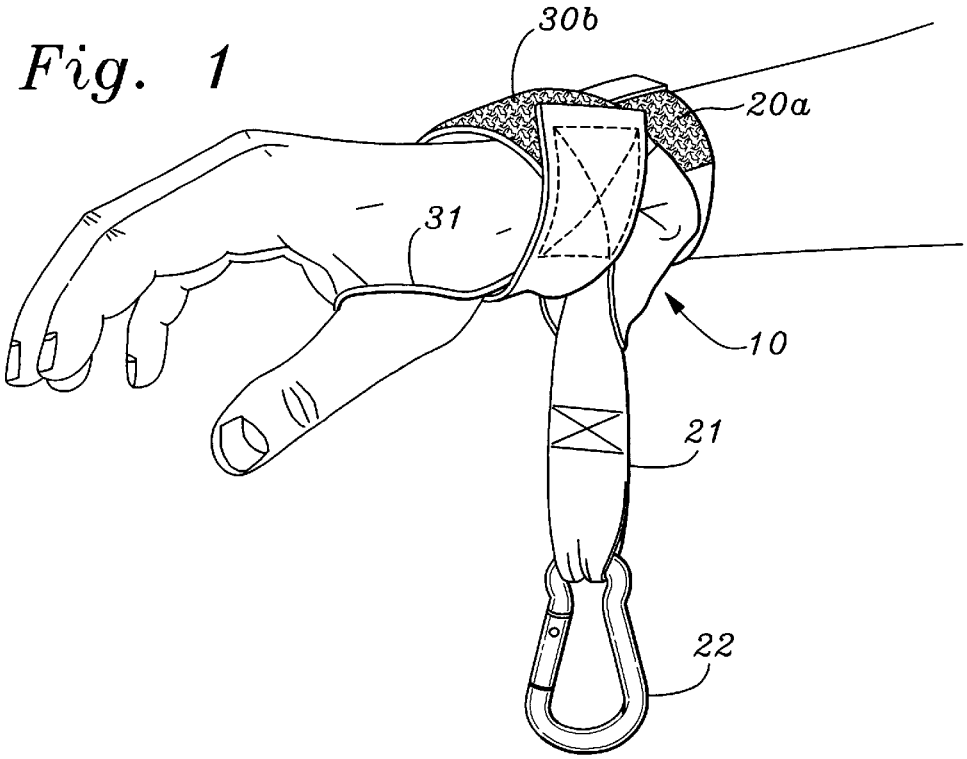
FIG. 1 is a perspective view of the wrist strap weight training apparatus in accordance with the invention showing the apparatus wrapped on the users arm in preparation for use.

As will be further described hereinbelow, the wrist strap apparatus of the present invention provides means for one with limited, weak, or virtually no handgrip strength, to participate in weight training.

The invention includes a first strap for wrapping around a human wrist which has a depending strap portion with an attachment clip for connection to weight training equipment, and if needed, a second strap for wrapping around the first strap for added strength and stabilization of the first strap during the weight training exercise. In this manner, all of the weight training effort is transferred to the wrist of the user. The second strap may include a thumb loop for anchoring during wrapping the second strap in completing the apparatus-wrapping maneuver.

Referring now to the drawings in general, there is shown the wrist strap apparatus of the invention, generally designated 10, wrapped around the wrist of the user in preparation for connection to weight lifting equipment, such as pulley equipment (not shown). The wrist strap apparatus 10 is shown comprised of two straps, a first strap, generally designated 20, which includes a depending strap portion 21 having a standard spring clip 22 at the end thereof for connection to the weight training equipment, and a second strap, generally designated 30, for providing increased stability to the wrist strap apparatus when in use. An anchoring thumb loop 31 is connected to stabilizing strap 30 as an aide in the wrapping or strap 30 around strap 20.

Figure 2:
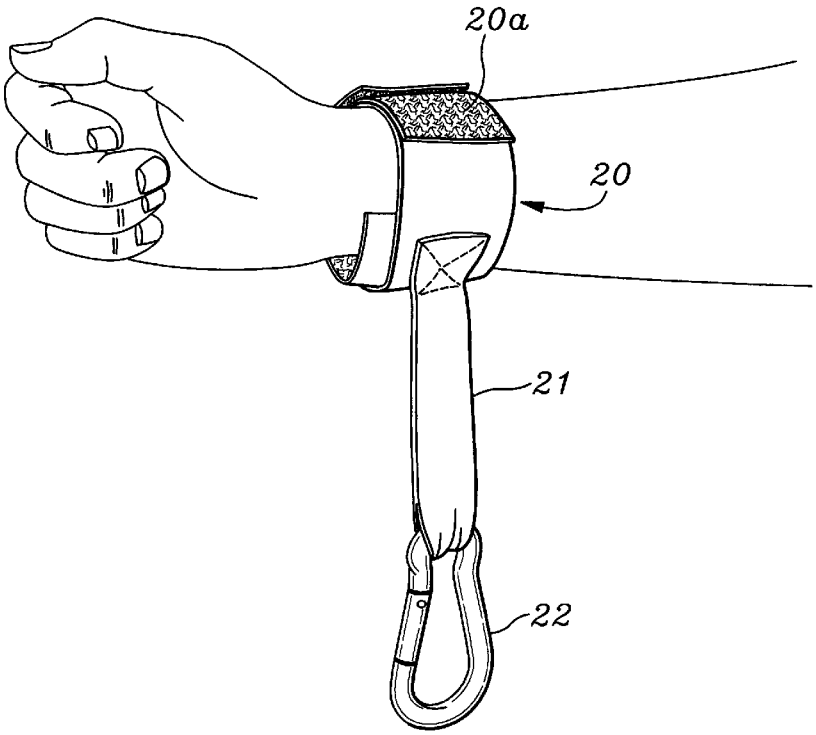
FIG. 2 is a perspective view of the initial strap wrapping in accordance with the invention showing the initial wrapping maneuver around the wrist.
Figure 3:
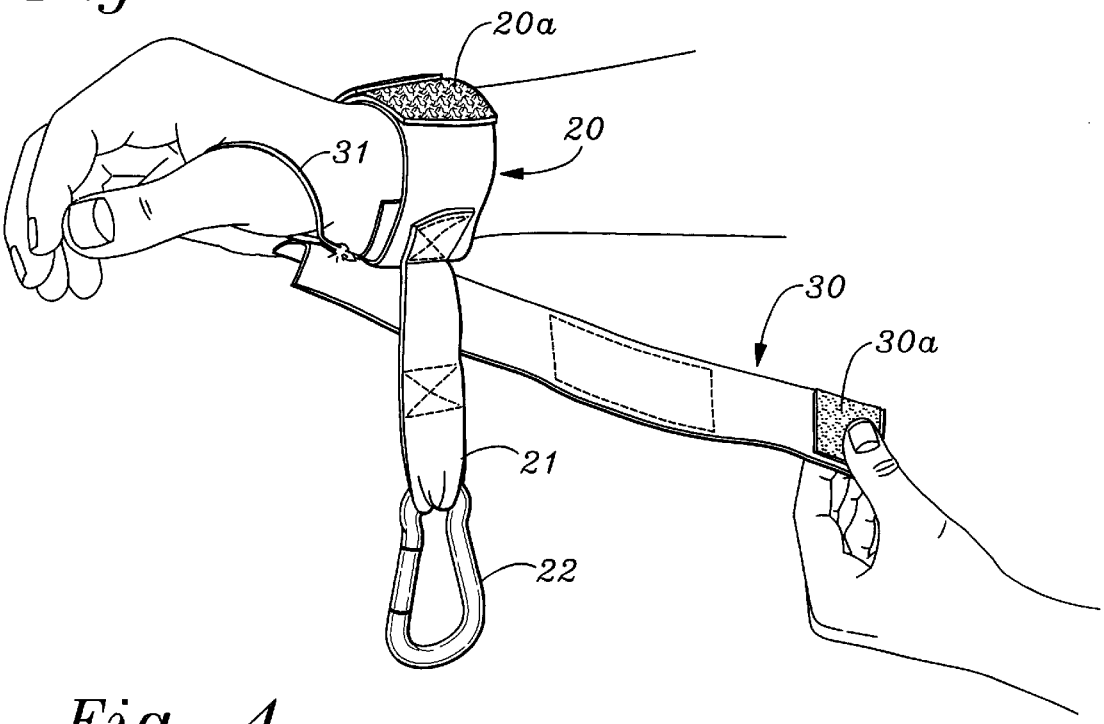
FIG. 3 is perspective view of the second strap wrapping in accordance with the invention showing the beginning of the second wrapping maneuver around the wrist.
Figure 4:
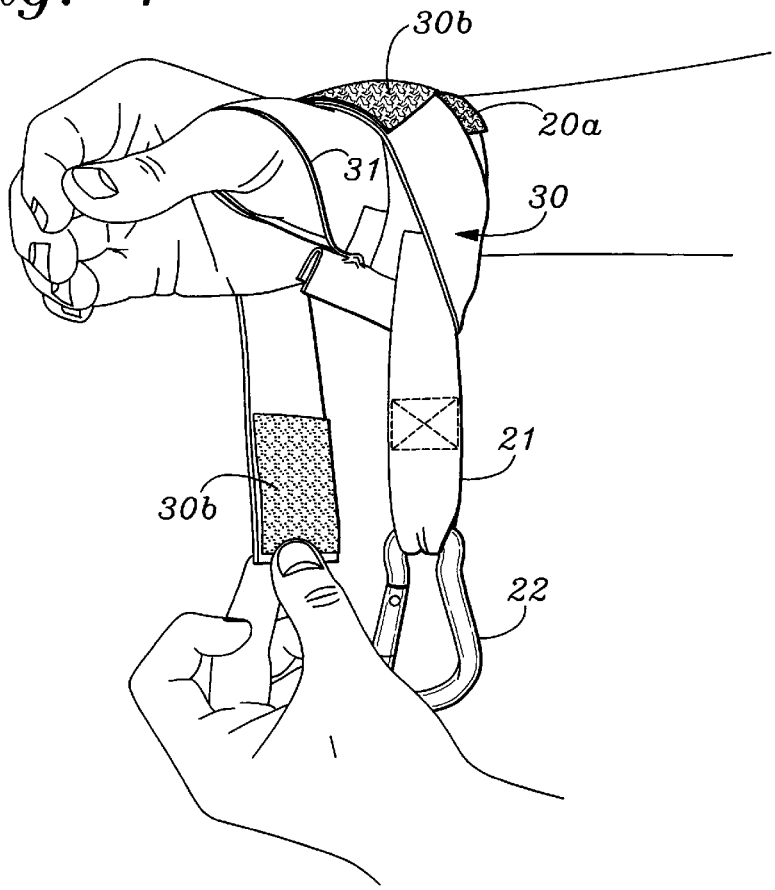
FIG. 4 is perspective view of the wrist strap apparatus in accordance with the invention showing the apparatus in partial completion of the second wrapping maneuver.

Referring to FIG. 2, there is shown the initial wrapping maneuver in placing the apparatus on the wrist of the user wherein strap 20 is wrapped and secured by any suitable means, such as VELCRO™ material, as will be hereinafter described. FIG. 3 illustrates the beginning of the second wrapping maneuver wherein strap 30 is added after completion of the positioning and securing of strap 20 to the wrist of the user. FIG. 4 illustrates a partial completion of the second wrapping maneuver of positioning strap 20.

Figure 7:
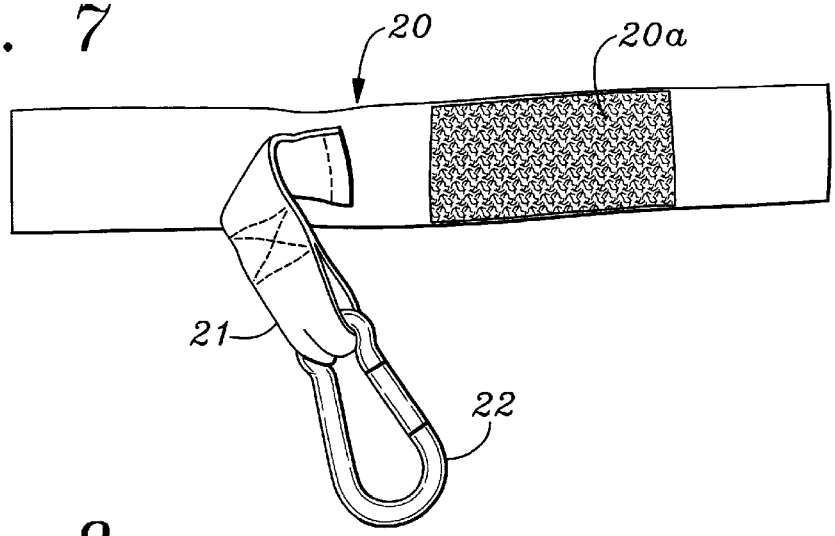
FIG. 7 is a plan view of the outer side of the second, or stabilizing, wrist strap in accordance with the invention.

FIG. 7 illustrates the outer surface of strap 20. The inner surface, i.e., the surface making contact with the wrist of the user when the strap is positioned on the wrist of the user, being illustrated in FIG. 8.

Referring to FIG. 7, strap 20 is approximately two inches in width, fourteen inches long, and formed of any suitable material having the strength and pliability necessary, such as nylon webbing. Strap portion 21 is about 1¼ inches wide and is formed of a more soft fibrous material, such as cloth. As viewed in the drawing, strap portion 21 is sewed, or otherwise suitably attached, at a first end thereof to the outer surface of strap 20 at about 4¼ inches from the left end of strap 20. Attached at this location on strap 20, strap 21 will depend from strap 20 as shown in FIG. 2 when strap 20 is wrapped around the wrist of the user as hereinafter described. The other end of portion 21 is looped through clip 22 and sewed back onto it to capture the spring releasable clip 22.

Sewed, or otherwise suitably attached, between the attachment point of strap 21 and the other end of strap 20 is VELCRO™ portion 20*a*, generally the "pile" portion, which covers the width of strap 20 and is approximately four inches long. The portion 20*a* starts at about 1¼ inch to the right of strap 21 and extends to about 2¾ inches from the right, or other, end of strap 20.

Figure 8:
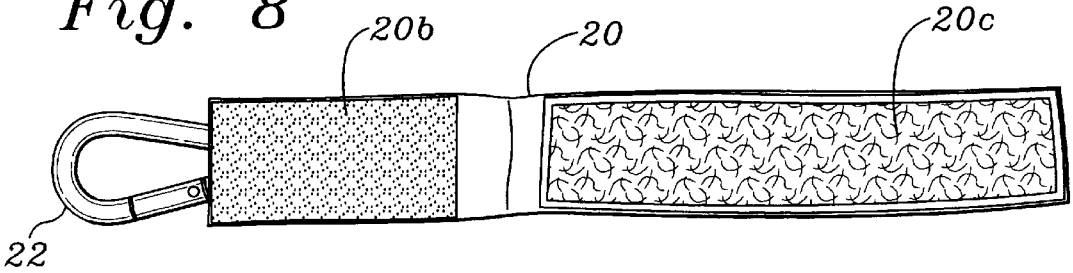
FIG. 8 is a plan view of the inner side of the second wrist strap in accordance with the invention.

FIG. 8 illustrates the other, or inner side of strap 20. Strap portion 20*b* is the mating portion, generally the "hook" portion, to VELCRO™ portion 20*a* and, as viewed in the drawing, extends back about four inches from the left end of the inner surface of strap 20. Portion 20*c* extends back about 8¾ inches from the other, or right, end of the inner surface of strap 20 and is formed of a soft material selected for wrist comfort when strap 20 is placed on the wrist.

Figure 5:
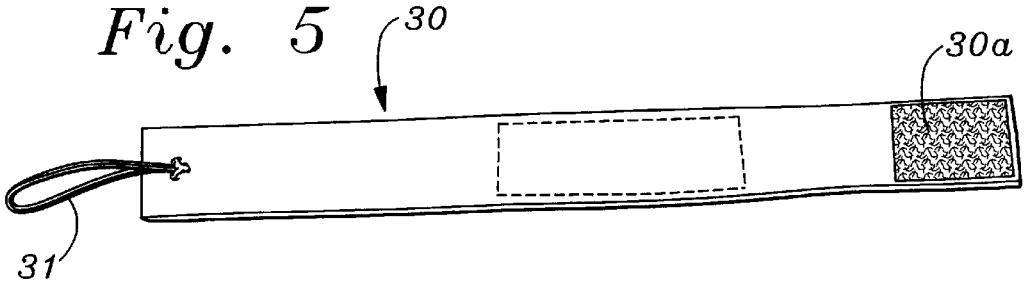
FIG. 5 is a plan view of the inner side of the first wrist strap in accordance with the invention.
Figure 6:
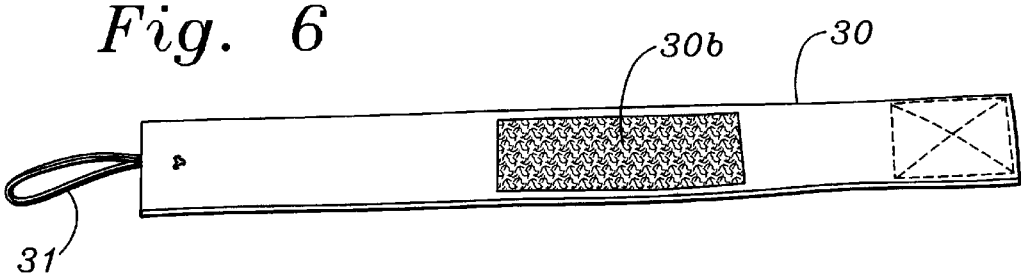
FIG. 6 is a plan view of the outer side of the first wrist strap in accordance with the invention.

FIG. 5 illustrates the inner side of strap 30 showing loop 31 attached to the left end of strap 30 and a VELCRO™ portion 30*a*, generally the "hook" portion, extending back about 2¼ inches from the right end of the inner surface of strap 30. Strap 30 is approximately 14¾ inches long and about 1½ inches wide with portion 30*a* covering the width of strap 30. FIG. 6 illustrates the outer side of strap 30 and shows the mating portion 30*b*, generally the "pile" portion, to VELCRO™ portion 30*a*. As viewed in the drawing, portion 30*b* covers the width of strap 30 and starts about six inches from the left end of strap 30 and extends for about 4½ inches.

Portion 20*c* extends back about 8¾ inches from the other, or right, end of the inner surface of strap 20 and is formed of a soft material selected for wrist comfort when strap 20 is placed on the wrist.

In application and use of the wrist strap apparatus of the present invention it is possible that only strap 20 be used, however, the addition of strap 30 provides additional stability to the apparatus, especially with the use of heavier weights.

Referring again to FIGS. 2 and 7, the first wrapping maneuver of strap 20 will now be explained. With strap 21 and clip 22 depending from the wrist of the user, the inner portion of the right end of strap 20 is first wrapped up, over and around the wrist of the user. Then, the left end of strap 20 is wrapped to overlap the right end, with the VELCRO™ portion 20*b* then mated to portion 20*a* to secure the wrapping. Wrapped in this manner the strap is ready for use as shown in FIG. 2.

If stabilizing strap 30 is to be used, anchoring loop 31 is first placed over the thumb of the user as an aide in wrapping strap 30. Then, grasping VELCRO™ portion 30*a* the inner surface of the strap 30 is first positioned under the wrist and behind the hanging strap 21. Strap 30 is then wrapped up, over and around previously positioned strap 20, with portion 30*a* then passed in front of strap 21 and then over strap 20 to be secured to outer surface portion 30*b* as shown in FIG. 1. This completes the second wrapping maneuver for positioning the apparatus 10 on the wrist of the user.

A preferred embodiment of the wrist strap for weight training invention has been shown and described by the foregoing disclosure and description, the strap formed of a few strong, simple and durable parts which will be easy to use and inexpensive to manufacture. The use herein of such terms as left, right, inner, outer, up, down, etc. are for clarity of description of the invention and not to be interpreted to limit the invention.

It will be apparent that various modifications and changes in the details of the illustrated construction may be made within the scope of the appended claims without departing from the true spirit and scope of the invention.

What is claimed is:

1. A method of lifting a heavy object comprising the steps of:

providing a first strap comprising a wrist strap for connecting around the wrist and an attachment portion depending from the wrist strap, the free end of the attachment portion having means for connecting to the object;

providing a stabilizing strap comprising a thumb loop at one end and a free end, and means for securing the free end;

wrapping the wrist strap about the wrist with the attachment portion depending therefrom;

anchoring said thumb loop about the thumb of the user;

wrapping the free end of the stabilizing strap around behind said depending attachment portion, then up, over and around the previously wrapped wrist strap, and then up in front of said attachment strap;

securing the free end of the stabilizing strap;

attaching the connecting means to the object; and lifting the object, whereby the weight of the object is borne by the wrist.

2. The method of claim 1, wherein the wrist strap includes overlapping hook and pile mating portions for securing said wrist strap to the wrist of the user.

3. The method of claim 1, wherein the wrist strap is formed of pliable synthetic material, and includes a wrist contact portion comprised of a layer of soft fibrous material for providing wrist comfort during use.

4. The method of claim 3, wherein said synthetic material is nylon webbing.

5. The method of claim 1, wherein the connecting means includes a releasable attachment clip for connection to object.

6. The method of claim 5, wherein the clip is a spring clip.

7. The method of claim 1, wherein said attachment portion is a strap formed of pliable fibrous material.

8. The method of claim 7, wherein the material is nylon webbing.

9. The method of claim 7, wherein the attachment strap is sewn to the wrist strap.

10. The method of claim 1, wherein said securing means includes overlapping hook and pile mating surfaces on said stabilizing strap.

11. A method of weight training comprising the steps of:

providing a first strap comprising a wrist strap for connecting around the wrist and an attachment portion depending from the wrist strap, the free end of the attachment portion having means for connecting to a piece of weight training equipment;

providing a stabilizing strap comprising a thumb loop at one end and a free end, and means for securing the free end;

wrapping the wrist strap about the wrist with the attachment portion depending therefrom;

anchoring said thumb loop about the thumb of the user;

wrapping the free end of the stabilizing strap around behind said depending attachment portion, then up, over and around the previously wrapped wrist strap, and then up in front of said attachment strap;

securing the free end of the stabilizing strap;

attaching the connecting means to the weight training equipment; and exercising using said equipment, whereby the training force provided by the equipment is transferred to the wrist of the user.

12. The method of claim 11, wherein the wrist strap includes overlapping hook and pile mating portions for securing said wrist strap to the wrist of the user.

13. The method of claim 11, wherein the wrist strap is formed of pliable synthetic material, and includes a wrist contact portion comprised of a layer of soft fibrous material for providing wrist comfort during use.

14. The method of claim 13, wherein said synthetic material is nylon webbing.

15. The method of claim 11, wherein the connecting means includes a releasable attachment clip for connection to object.

16. The method of claim 15, wherein the clip is a spring clip.

17. The method of claim 11, wherein said attachment portion is a strap formed of pliable fibrous material.

18. The method of claim 17, wherein the material is nylon webbing.

19. The method of claim 17, wherein the attachment strap is sewn to the wrist strap.

20. The method of claim 11, wherein said securing means includes overlapping hook and pile mating surfaces on said stabilizing strap.

* * * * *